US006865835B1

(12) United States Patent
Webster

(10) Patent No.: US 6,865,835 B1
(45) Date of Patent: Mar. 15, 2005

(54) ILLUMINATED MESSAGE DISPLAY

(76) Inventor: Allen E. Webster, 801 Rainier Ave. N. G337, Renton, WA (US) 98055

( * ) Notice: Subject to any disclaimer, the term of this patent is extended or adjusted under 35 U.S.C. 154(b) by 0 days.

(21) Appl. No.: 10/306,420

(22) Filed: Nov. 27, 2002

(51) Int. Cl.[7] ..... G09F 21/04
(52) U.S. Cl. ..... 40/591; 40/452
(58) Field of Search ..... 40/590, 591, 452, 40/463; 362/812

(56) References Cited

U.S. PATENT DOCUMENTS 5,636,462 A * 6/1997 Kleiman ..... 40/452
6,067,011 A * 5/2000 Leslie ..... 340/468
6,515,583 B1 * 2/2003 Lamparter et al. ..... 340/433
6,558,021 B2 * 5/2003 Wu et al. ..... 362/249

* cited by examiner

*Primary Examiner*—S. Joseph Morano
*Assistant Examiner*—Robert J. McCarry, Jr.
(74) *Attorney, Agent, or Firm*—Polly L. Oliver

(57) ABSTRACT

Illuminated message displays improve improving traffic safety by notifying drivers of the turning characteristics of semi trailers. Lamps mounted on the front of a circuit board and controlled by a microprocessor display a pattern of messages to warn motorists of the need to not be adjacent to a semi trailer when it makes a right hand turn, to notify motorists when a right hand turn is imminent, and to thank motorists for their cooperation. A wire connects the microprocessor and circuit board to the taillights of a semi trailer so that they are powered when the taillights are turned on. Circuit board holders releasably attach the circuit board to the rear door of a semi trailer. A pair of brackets with end caps are attached to the bottom of the rear bumper of a semi trailer to hold the circuit board and plates safely out of the way when the rear door of the semi trailer is opened.

16 Claims, 5 Drawing Sheets

ILLUMINATED MESSAGE DISPLAY

BACKGROUND OF THE INVENTION

1. Field of the Invention

The present invention relates to an illuminated message display for use in connection with communicating a message. The illuminated message display has particular utility in connection with improving traffic safety by notifying drivers of the turning characteristics of semi trailers.

2. Description of the Prior Art

Illuminated message displays are desirable for improving traffic safety by notifying drivers of the turning characteristics of semi trailers. Semi trailers are long, box-like structures pulled by a tractor that is pivotably attached to the forward end of the semi trailer. Because the tractor is much shorter than the semi trailer, the path of the tractor around the corner is much more of a curve than that of the semi trailer. As a result, the driver of the tractor must approach an intersection in the second (inside) lane, rather than the curb lane, when he desires to make a right hand turn. When the tractor turns right out of the second lane, the right side of the semi trailer enters a portion of the area of the curb lane prior to again becoming aligned with the path of the tractor as it completes the turn. However, the semi trailer remains on the road, which is far better than the alternative of entering the sidewalk. Unfortunately, unwary motorists may advance their vehicles in the curb lane up to the intersection adjacent to the semi trailer if they are not warned away, resulting in a collision between their vehicle and the semi trailer when the semi trailer makes its right turn. Illuminated message displays communicate the need for the motorist to stay behind the semi trailer when it is making a right turn, notify the motorist when the right turn is imminent, and thank the motorist for remaining behind the semi trailer after the right turn is completed.

The use of signaling devices is known in the prior art. For example, U.S. Pat. No. 4,622,494 to Johnson discloses a signaling device. However, the Johnson '494 patent does not have the ability to display multiple messages in rapid succession, and has further drawbacks of lacking a microprocessor.

U.S. Pat. No. 6,138,394 to Sulenski discloses a portable directional arrow that directs traffic at any time during the day or night. However, the Sulenski '394 patent does not have the ability to display multiple messages in rapid succession, and additionally does not have a microprocessor.

Similarly, U.S. Pat. No. Des. 319,888 to Brandon discloses an auxiliary illuminated turn signal for semi-trailers that displays the message WIDE TURN. However, the Brandon '888 patent does not have a microprocessor, and cannot display multiple messages in rapid succession.

In addition, U.S. Pat. No. 5,355,117 to Jefferson discloses a vehicle warning sign that warns motorists against blocking access of a wheelchair to a wheelchair lift aboard a vehicle. However, the Jefferson '117 patent does not have the ability to display multiple messages in rapid succession, and also does not have a microprocessor.

Furthermore, U.S. Pat. No. 5,103,205 to Halligan discloses a traffic warning and directional information apparatus that mounts on the trunk of a vehicle. However, the Halligan '205 patent does not have the ability to display multiple messages in rapid succession, and further lacks a microprocessor.

Moreover, U.S. Pat. No. 5,636,462 to Kleiman discloses an illuminated flashing message display sign apparatus with different operative positions that displays a built-in message of two words. However, the Kleiman '462 patent does not have a microprocessor, and has the additional deficiency of not being able to display messages other than the two built-in words.

U.S. Pat. No. 4,297,675 to Rubottom et al. discloses a supplemental right turn signal for semi trailers that warns a motorist that the driver of the tractor pulling the semi trailer is planning to make a right turn. However, the Rubottom et al. '675 patent does not have a microprocessor, and also is unable to display multiple messages in rapid succession.

Lastly, U.S. Pat. No. 2,854,650 to Baker et al. discloses a safety signaling device for motor vehicles that indicates to vehicles in the rear thereof and traveling in the same direction whether or not it is safe to pass. However, the Baker et al. '650 patent does not have a microprocessor, and cannot display messages other than the indicia built into the panel.

While the above-described devices fulfill their respective, particular objectives and requirements, the aforementioned patents do not describe an illuminated message display that allows improving traffic safety by notifying drivers of the turning characteristics of semi trailers. The above patents make no provision for a microprocessor. The Johnson '494 patent, the Sulenski '394 patent, the Brandon '888 patent, the Jefferson '117 patent, the Halligan '205 patent, and the Rubottom et al. '675 patent cannot display multiple messages in rapid succession. The Kleiman '462 patent is limited to displaying only the two built-in words, and the Baker et al. '650 patent cannot display messages other than the indicia built into the panel.

Therefore, a need exists for a new and improved illuminated message display that can be used for improving traffic safety by notifying drivers of the turning characteristics of semi trailers. In this regard, the present invention substantially fulfills this need. In this respect, the illuminated message display according to the present invention substantially departs from the conventional concepts and designs of the prior art, and in doing so provides an apparatus primarily developed for the purpose of improving traffic safety by notifying drivers of the turning characteristics of semi trailers.

SUMMARY OF THE INVENTION

In view of the foregoing disadvantages inherent in the known types of signaling devices now present in the prior art, the present invention provides an improved illuminated message display, and overcomes the above-mentioned disadvantages and drawbacks of the prior art. As such, the general purpose of the present invention, which will be described subsequently in greater detail, is to provide a new and improved illuminated message display which has all the advantages of the prior art mentioned heretofore and many novel features that result in a illuminated message display which is not anticipated, rendered obvious, suggested, or even implied by the prior art, either alone or in any combination thereof.

To attain this, the present invention essentially comprises a circuit board with a lamp connected to its front face and a circuit board holder and a display cable attached to its end. The display cable has a display controller connected to its opposing end, and a wire has one end connected to the display controller.

There has thus been outlined, rather broadly, the more important features of the invention in order that the detailed description thereof that follows may be better understood and in order that the present contribution to the art may be better appreciated.

The invention may also include a panel covering the circuit board. The panel may be translucent and may be red in color. The display controller may be a microprocessor. The lamp may be of the supernova LED type. The circuit board holder may comprise a plate with a first band and a second band frictionally engaged with the front face of the plate. The end of the first band may be releasably connected to the end of the second band by a latch. The display controller may be able to be programmed to light the lamps to display multiple messages in rapid succession. The messages may be at least one of the group consisting of WIDE RIGHT TURN, and crawling arrows pointed to the right, THANK YOU There may be a bracket mounted to the rear bumper of a semi trailer, and the bracket may be J-shaped with an end cap on one end. The invention may be an improvement to a semi trailer. The wire may have its opposing end connected to the rear lights of a semi trailer. The circuit board may be made of plastic. The panel may be made of plastic or glass. The circuit board holder may be made of plastic, steel, aluminum, titanium, or carbon fiber composite. The combined length of the circuit board and the plates may be about 14½ inches. The circuit board may have a height of about 10½ inches. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminated message display that has all of the advantages of the prior art signaling devices and none of the disadvantages.

It is another object of the present invention to provide a new and improved illuminated message display that may be easily and efficiently manufactured and marketed.

An even further object of the present invention is to provide a new and improved illuminated message display that has a low cost of manufacture with regard to both materials and labor, and which accordingly is then susceptible of low prices of sale to the consuming public, thereby making such illuminated message display economically available to the buying public.

Still another object of the present invention is to provide a new illuminated message display that provides in the apparatuses and methods of the prior art some of the advantages thereof, while simultaneously overcoming some of the disadvantages normally associated therewith.

Even still another object of the present invention is to provide an illuminated message display for improving traffic safety by notifying drivers of the turning characteristics of semi trailers. This allows the illuminated message display to display a wide variety of messages.

Still yet another object of the present invention is to provide an illuminated message display for improving traffic safety by notifying drivers of the turning characteristics of semi trailers. This makes it possible for the illuminated message display to display a sequence of messages in rapid succession.

An additional object of the present invention is to provide an illuminated message display for improving traffic safety by notifying drivers of the turning characteristics of semi trailers. This allows the message to be visible regardless of the ambient light conditions.

A further object of the present invention is to provide an illuminated message display for improving traffic safety by notifying drivers of the turning characteristics of semi trailers. This reduces the chance that the semi trailer will be involved in an accident.

Lastly, it is an object of the present invention to provide a new and improved illuminated message display for improving traffic safety by notifying drivers of the turning characteristics of semi trailers.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
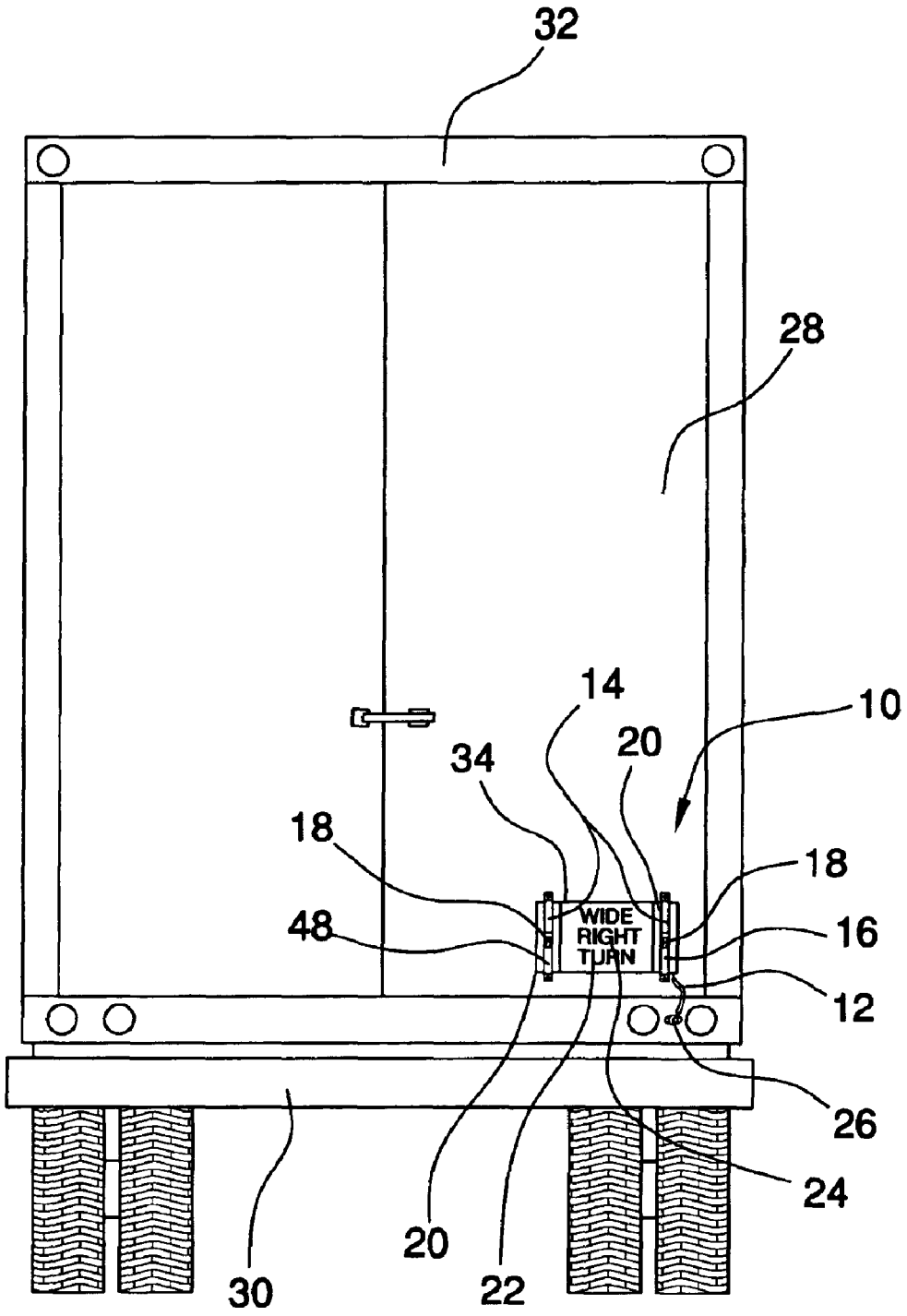
FIG. 1 is a front side view of the current embodiment of the illuminated message display constructed in accordance with the principles of the present invention.

Referring now to the drawings, and particularly to FIGS. 1–5, a current embodiment of the illuminated message display of the present invention is shown and generally designated by the reference numeral 10.

In FIG. 1, a new and improved illuminated message display 10 of the present invention for improving traffic safety by notifying drivers of the turning characteristics of semi trailers is illustrated and will be described. More particularly, the illuminated message display 10 has a wire 12 having opposing ends with one end connected to the rear lights 26 of a semi trailer 32 and its opposing end connected to a display controller 44 (not shown) contained within plate 20. The plate 20 protects the display controller 44 from damage. The plates 20 are removably attached to the rear door 28 of the semi trailer 32 by first bands 14 and second bands 16. The end of the first bands 14 is releasably connected to the end of the second bands 16 by latches 18. When latches 18 are closed, first bands 14 and second bands 16 are frictionally engaged with the front face of plates 20, thereby securing plates 20 in place against the rear door 28. First bands 14, second bands 16, latches 18, and plates 20 comprise circuit board holder 48. Circuit board 34 has its opposing ends attached to plates 20. Lamps 22 are connected to the front face of circuit board 34. Display controller 44 causes selected lamps 22 to illuminate by passing electrical current through the appropriate parts of circuit board 34 to light selected lamps 22, thereby making a message 24 visible. In the current embodiment, message 24 is WIDE RIGHT TURN, circuit board 34 is made of plastic, and the components of the circuit board holder 48 are made of steel. The circuit board has a height of about 10½ inches and the combined length of the circuit board and the plates is about 14½ inches in the current embodiment. Note that the rear lights 26, rear door 28, rear bumper 30, and semi trailer 32 are for illustrative purposes only and are not part of the current invention.

Figure 2:
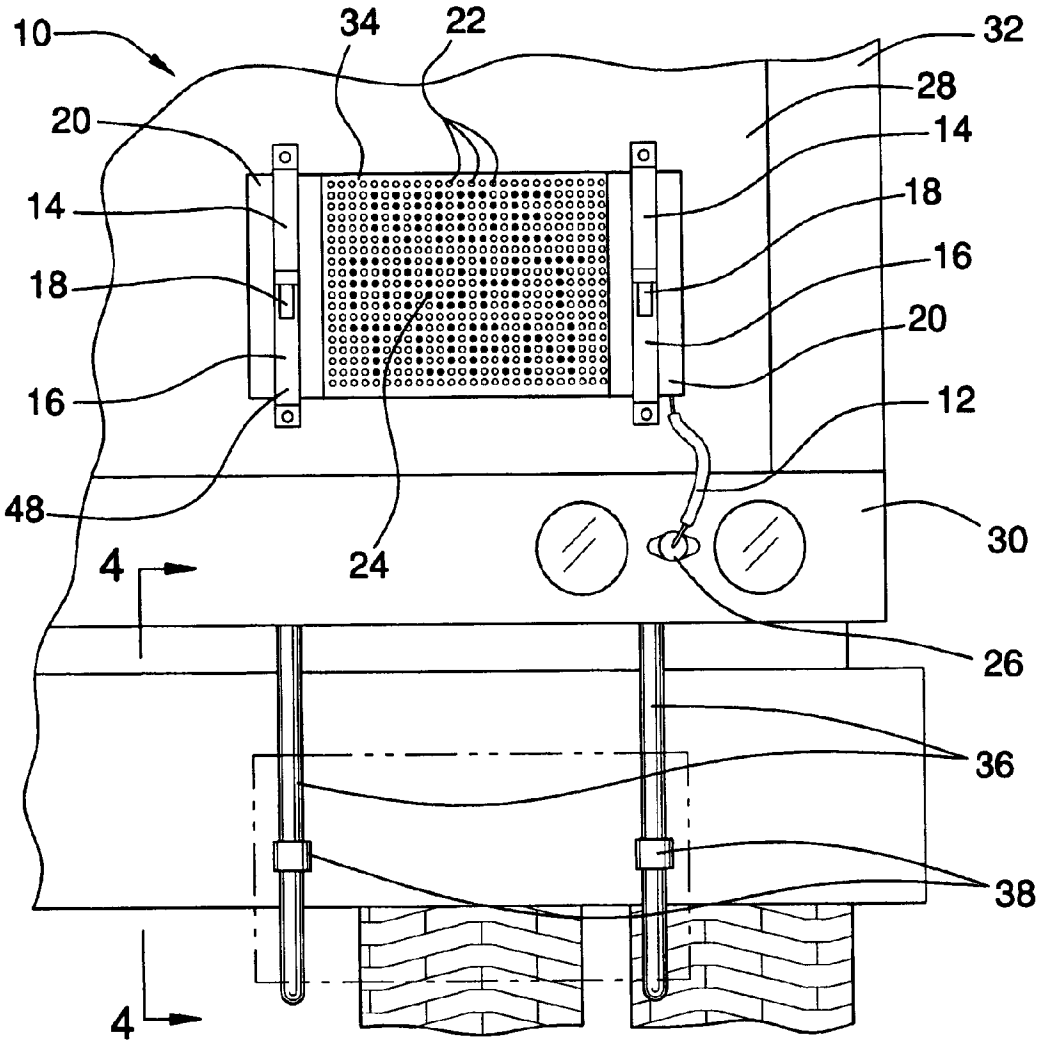
FIG. 2 is a front side view of the illuminated message display of the present invention.

Moving on to FIG. 2, a new and improved illuminated message display 10 of the present invention for improving traffic safety by notifying drivers of the turning characteristics of semi trailers is illustrated and will be described. More particularly, the illuminated message display 10 has a circuit board holder 48 releasably connecting circuit board 34 to the rear door 28 of a semi trailer 32. Circuit board holder 48 comprises first bands 14, second bands 16, latches 18, and plates 20. Wire 12 extends from the bottom of one of plates 20 and connects to the rear lights 26 of the semi trailer 32. Brackets 36 with end caps 38 attached to one end are attached to the bottom of the rear bumper 30. Lamps 22 connected to the front face of circuit board 34 are lit to form the message 24 WIDE RIGHT TURN. Note that the rear lights 26, rear door 28, rear bumper 30, and semi trailer 32 are for illustrative purposes only and are not part of the current invention.

Figure 3:
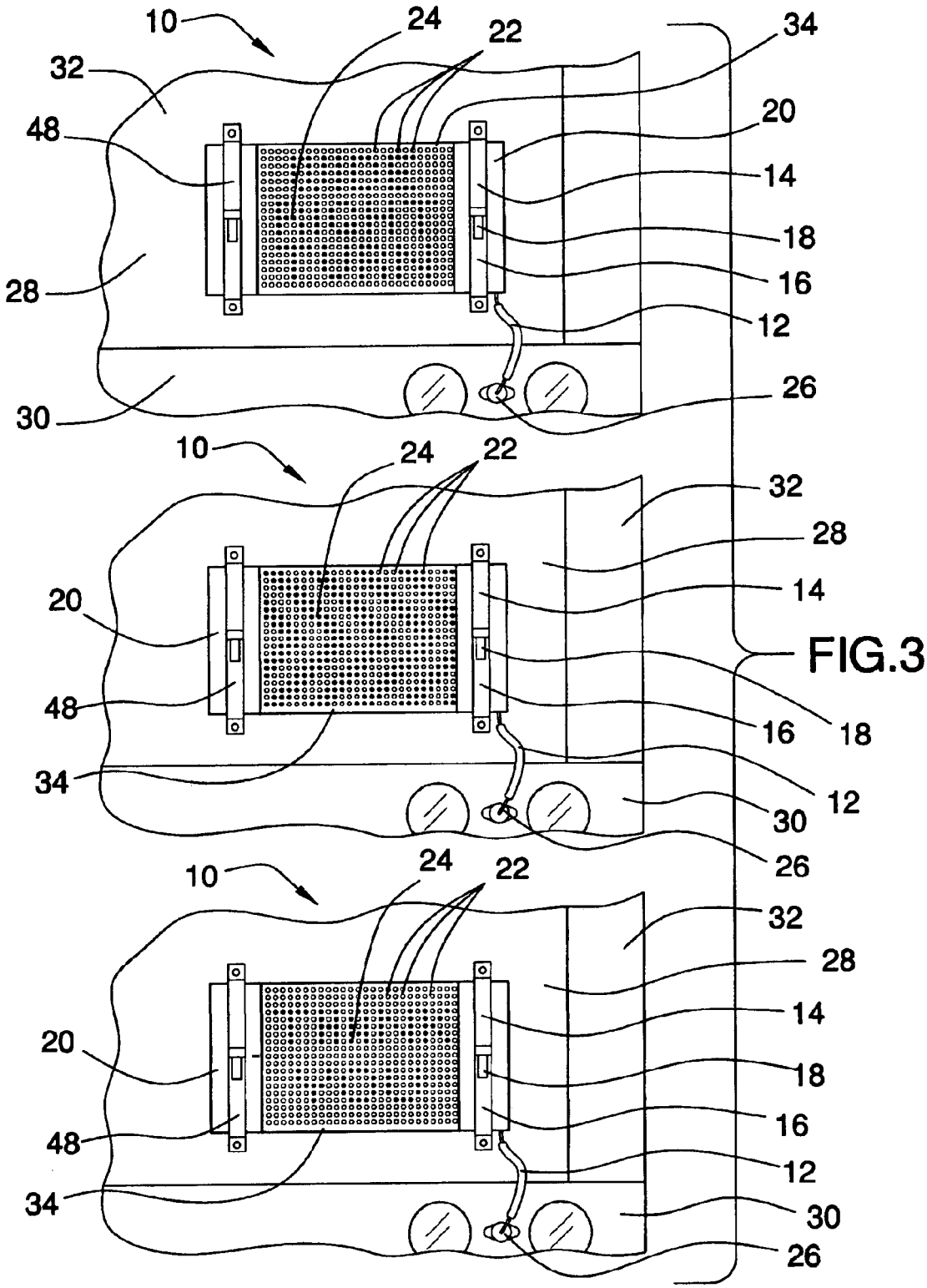
FIG. 3 is a front side view of the illuminated message display of the present invention.

Continuing with FIG. 3, a new and improved illuminated message display 10 of the present invention for improving traffic safety by notifying drivers of the turning characteristics of semi trailers is illustrated and will be described. More particularly, the illuminated message display 10 has a circuit board 34 releasably secured to the rear door 28 of a semi trailer 32 by circuit board holders 48. Wire 12 is shown connected to rear lights 26 and transmits power to the display controller 44 (not shown) to light lamps 22 to form a message 24. Three different possible messages 24, which can be shown in the sequence in which they are presented, are displayed in FIG. 3. The messages 24 are WIDE RIGHT TURN, crawling arrows pointed to the right, and THANK YOU. The circuit board holders 48 comprise first bands 14, second bands 16, and latches 18. Note that the rear lights 26, rear door 28, rear bumper 30, and semi trailer 32 are for illustrative purposes only and are not part of the current invention.

Figure 4:
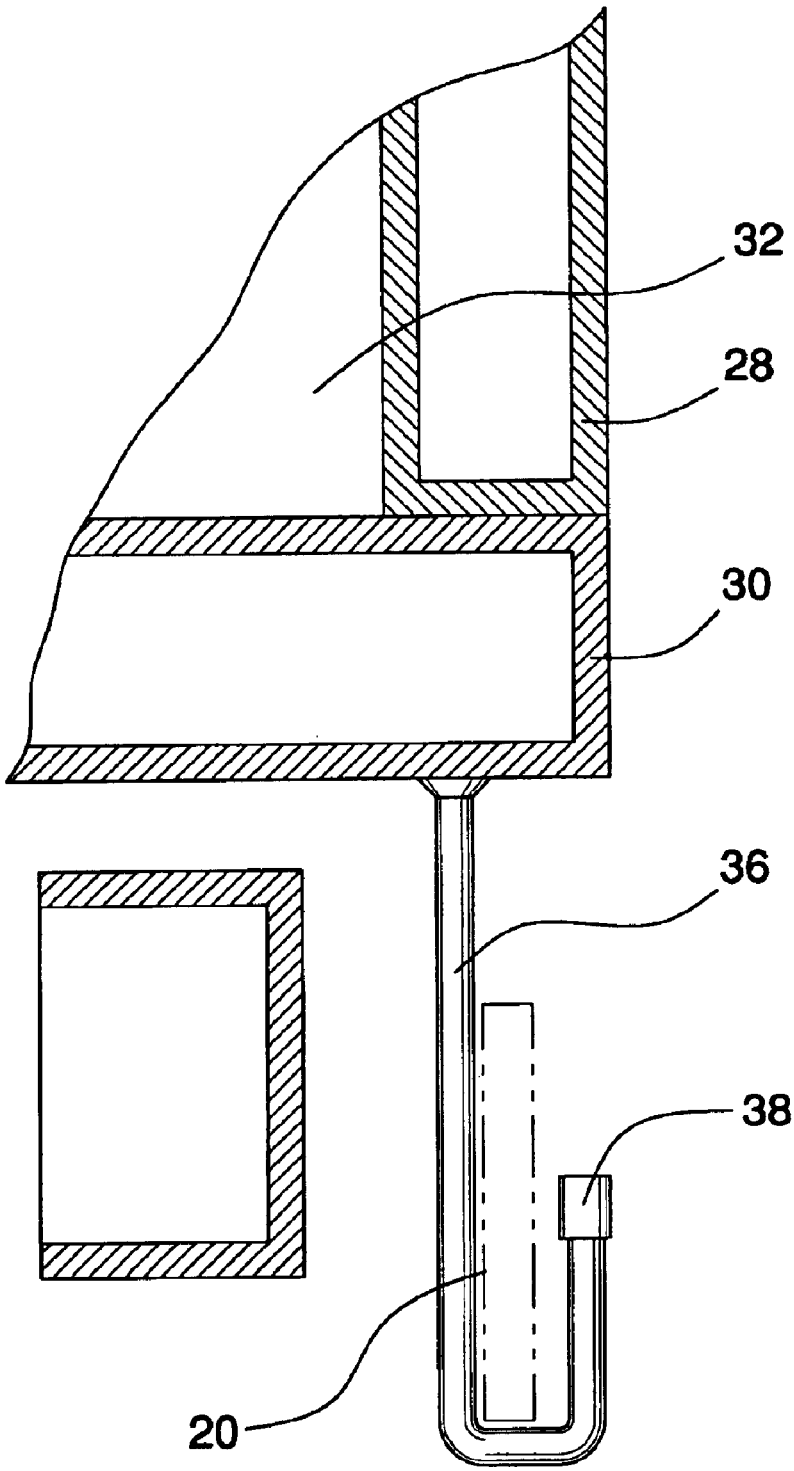
FIG. 4 is a left side view of the bracket of the present invention.

In FIG. 4, a new and improved bracket 36 of the present invention for improving traffic safety by notifying drivers of the turning characteristics of semi trailers is illustrated and will be described. More particularly, the bracket 36 has an end cap 38 attached to one end. The opposing end of bracket 36 is attached to the underside of the rear bumper 30 of the semi trailer 32. In the current embodiment, bracket 36 is J-shaped to receive the plates 20 attached to the circuit board 34. Bracket 36 is used to hold the plate 20, denoted by the broken lines, and attached circuit board 34 (not visible) when it is necessary to open the rear door 28 of the semi trailer 32. When held by bracket 36, plates 20 and circuit board 34 are protected from damage while semi trailer 32 is being loaded or unloaded. The end cap 38 serves to protect the plate 20 and circuit board 34 in the event they come into contact with the end of bracket 36. Note that the lines illustrating the semi trailer 32, rear door 28, and rear bumper 30 are for illustrative purposes only and are not part of the current invention.

Figure 5:
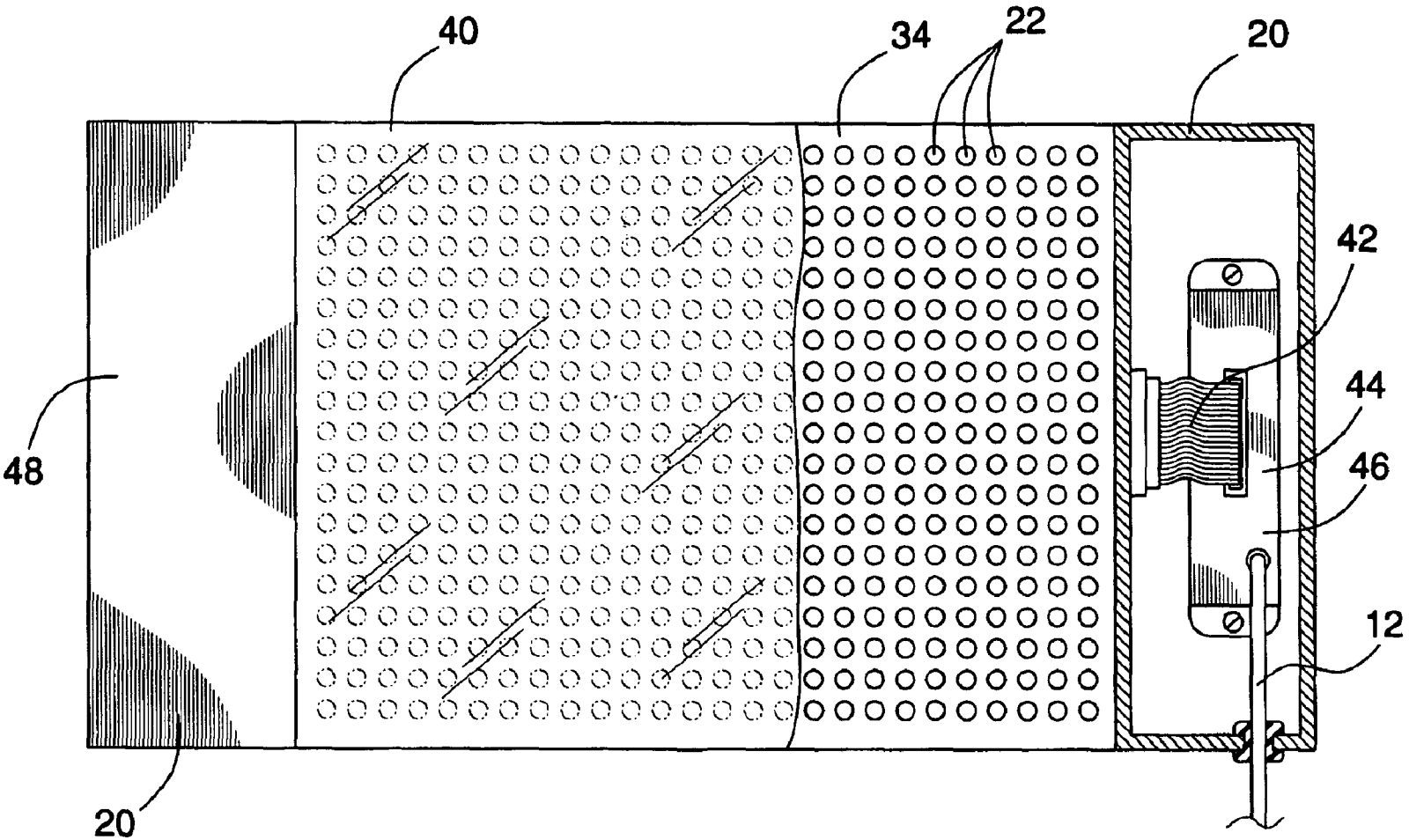
FIG. 5 is a front side sectional view of the circuit board of the present invention.

Concluding with FIG. 5, a new and improved circuit board 34 of the present invention for improving traffic safety by notifying drivers of the turning characteristics of semi trailers is illustrated and will be described. More particularly, the circuit board 34 has a panel 40 covering its front face. In the current embodiment, panel 40 is red in color and made of translucent plastic. Panel 40 is translucent so that lamps 22 can be seen when they are lit. Panel 40 is red so that the light passing through it catches motorists' attention. The opposing ends of circuit board 34 are attached to plates 20, which comprise a portion of the circuit board holders 48. The display controller 44, in this case a microprocessor 46, is shown mounted inside of one of the plates 20. The display cable 42 connects the display controller 44 to the circuit board 34 so that the flow of power to each of the lamps 22 can be controlled by microprocessor 46. Wire 12 is shown with one end connecting display controller 44 to the rear lights 26 (not shown) of semi trailer 32 (not shown) so that display controller 44 is powered when the rear lights 26 are turned on.

In use, it can now be understood that first bands 14 and second bands 16 are releasably connected by latches 18 to removably secure plates 20 in place to the rear door 28 of a semi trailer 32. Wire 12 is then plugged into the rear lights 26. When the driver of the tractor powers on the headlights, rear lights 26, and running lights, the lamps 22 display the message 24 WIDE RIGHT TURN. When the driver activates the right turn signal switch, the display controller 44 changes which lamps 22 are lit so as to display the message 24 of crawling arrows pointed to the right. Once the right turn signal switch is deactivated, the display controller 44 changes which lamps 22 are lit so as to display the message 24 THANK YOU for approximately 8 seconds. Then, the display controller 44 deactivates all of the lamps 22 for about three seconds so that there is no message 24. Finally, the display controller 44 reactivates the appropriate lamps 22 to display the message 24 WIDE RIGHT TURN. The lamps 22 are lit in some fashion, with the exception of the period described above, as long as the rear lights 26 of the semi trailer 32 are powered. When the driver needs to access the rear door 28, he releases latches 18 to separate first bands 14 and second bands 16 so that plates 20 and circuit board 34 can be detached from the rear door 28. He then places plates 20 in brackets 36 to keep circuit board 34 safe while semi trailer 32 is being loaded or unloaded. Once rear door 28 is closed, plates 20 are again removably secured to the rear door 28 by the first bands 14, second bands 16, and latches 18.

While a current embodiment of the illuminated message display has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, aluminum, titanium, or carbon fiber composite may be used instead of the steel circuit board holders described. Also, the plastic panel may also be made of glass or a similarly translucent material. And although improving traffic safety by notifying drivers of the turning characteristics of semi trailers has been described, it should be appreciated that the illuminated message display herein described is also suitable for displaying advertisements. Furthermore, a wide variety of lamps may be used instead of the supernova LED lamps described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminated message display for use on a vehicle having rear lights and a right turn signal comprising:

A circuit board having opposing ends and a front face;

A lamp connected to said front face of said circuit board, such lamp being of the supernova LED type;

A circuit board holder attached to said end of said circuit board, said circuit board holder comprising a plate having a front face, a first band having opposing ends with one end frictionally engaged with said front face of said plate, a second band having opposing ends with one end frictionally engaged with said front face of said plate, and a latch releasably connecting said end of said first band with said end of said second band;

A display cable having opposing ends with one end connected to said end of said circuit board;

A display controller attached to said opposing end of said display cable and mounted within said circuit board holder; and A wire having opposing ends with one end connected to said display controller and the opposing end connected to the rear lights of the vehicle such that the circuit board will be activated thereby.

2. The illuminated message display as defined in claim 1, further comprising a panel covering said front face of said circuit board.

3. The illuminated message display as defined in claim 2, wherein said panel is translucent.

4. The illuminated message display as defined in claim 3, wherein said panel is selected from the group consisting of plastic and glass.

5. The illuminated message display as defined in claim 3, wherein said panel is red in color.

6. The illuminated message display as defined in claim 1, wherein said display controller is a microprocessor.

7. The illuminated message display as defined in claim 1, wherein said circuit board holder is selected from the group consisting of plastic, steel, aluminum, titanium, and carbon fiber composite.

8. An illuminated message display for use on a vehicle having lights and a right turn signal comprising:

A wire having opposing ends with one end connected to the rear lights of the vehicle;

A display controller connected to the opposing end of said wire;

A display wire having opposing ends with one end connected to said display controller;

A circuit board having opposing ends and a front face with one end connected to said display wire and being configured to be activated by the rear lights of the vehicle;

A plurality of circuit board holders attached to said opposing ends of said circuit board, comprising a plurality of plates having a front face, a plurality of first bands having opposing ends with one end frictionally engaged with said front face of said plate, a plurality of second bands having opposing ends with one end frictionally engaged with said front face of said plates, and a plurality of latches releasably connecting said end of said first bands with said end of said second bands;

A plurality of lamps connected to said front face of said circuit board, such lamps being of the supernova LED type; and A panel covering said front face of said circuit board.

9. The illuminated message display as defined in claim 8, wherein said display controller can be programmed to light said lamps to display multiple messages in rapid succession.

10. The illuminated message display as defined in claim 8, wherein said messages are at least one of the group consisting of WIDE RIGHT TURN, crawling arrows pointed to the right, and THANK YOU.

11. The illuminated message display as defined in claim 8, wherein said circuit board has a height of approximately 10½ inches.

12. The illuminated message display as defined in claim 8, wherein the combined length of said circuit board and said plates is about 14½ inches.

13. The illuminated message display as defined in claim 8, wherein said circuit board is made of plastic.

14. In combination with a semi trailer, including rear lights, a rear door, and a rear bumper, the improvement which comprises:

a bracket having opposing ends with one end attached to said rear bumper;

a plurality of first bands having opposing ends with one end attached to said rear door;

a plurality of latches releasably connecting said opposing end of said first bands with said opposing end of said second bands;

a plurality of plates having a front face and a side of said front face frictionally engaged with said end of said first bands and said second bands;

a circuit board having opposing ends and a front face with said opposing ends attached to said side of said plates;

a panel covering said front face of said circuit board;

a microprocessor enclosed by said plate;

a display cable having opposing ends with one end connected to said end of said circuit board and said opposing end connected to said microprocessor; and a wire having opposing ends with one end connected to said microprocessor and said opposing end connected to said rear lights and being activated thereby.

15. The improvement to a semi trailer as defined in claim 14, wherein said bracket is J-shaped.

16. The improvement to a semi trailer as defined in claim 14, further comprising an end cap attached to said opposing end of said bracket.

* * * * *